United States Patent [19]

Schulz et al.

[11] Patent Number: 4,810,345

[45] Date of Patent: Mar. 7, 1989

[54] DIAPHRAGM FOR AN ELECTROLYTIC CELL

[75] Inventors: Arthur C. Schulz, No. Tonawanda; Tilak V. Bommaraju, Grand Island; Robert Kiszewski, Niagara Falls, all of N.Y.; Ursula I. Keller, Queenston, Canada

[73] Assignee: OxyTech Systems, Inc., Chardon, Ohio

[21] Appl. No.: 123,520

[22] Filed: Nov. 18, 1987

Related U.S. Application Data

[63] Continuation-in-part of Ser. No. 941,459, Dec. 15, 1986, Pat. No. 4,741,813.

[51] Int. Cl.[4] ..... C25B 13/00

[52] U.S. Cl. ..... 204/296; 204/295

[58] Field of Search ..... 204/295, 296

[56] References Cited

U.S. PATENT DOCUMENTS

| | | | |
|---|---|---|---|
| 4,402,816 | 9/1983 | Kadija | 204/296 |
| 4,545,886 | 10/1985 | De Nora et al. | 204/295 |
| 4,741,813 | 5/1988 | Schulz et al. | 204/295 |

*Primary Examiner*—R. L. Andrews

*Attorney, Agent, or Firm*—John J. Freer

[57] ABSTRACT

An improved diaphragm for an electrolytic cell is prepared by mixing a slurry of an additive, such as poly-(ethylene chlorotrifluoroethylene), and asbestos fibers with a dispersion of titanium dioxide in isopropyl alcohol, depositing the treated asbestos fibers onto a cathode, heating the diaphragm to an elevated temperature of from about 100° C. to about 400° C., and allowing the diaphragm to cool.

The diaphragm prepared according to this process exhibits improved mechanical strength and integrity as well as a decrease in electrical energy consumption in comparison to diaphragms prepared using conventional techniques.

12 Claims, No Drawings

DIAPHRAGM FOR AN ELECTROLYTIC CELL

CROSS-REFERENCE TO RELATED APPLICATION

This application is a continuation-in-part of U.S. application Ser. No. 941,459, filed Dec. 15, 1986, now U.S. Pat. No. 4,741,813

BACKGROUND OF THE INVENTION

The present invention relates to a process for preparing an improved diaphragm for use in chlor-alkali electrolytic cells. The diaphragm of this invention has improved mechanical properties which result in superior electrical performance and increased energy savings.

The chlor-alkali industry currently employs a large number of electrolytic diaphragm cells for the commercial production of chlorine and caustic soda. These electrolytic cells have an anode contained in an anolyte chamber and a cathode contained in a catholyte chamber separated by a porous diaphragm. The diaphragm is generally formed by depositing a slurry of asbestos fibers directly onto the foraminous cathode. The cells contain brine which is electrolyzed to produce chlorine gas in the anolyte chamber and sodium hydroxide (caustic) in the catholyte chamber.

Technical advances in this field have generated various improvements in component service life and cell operating efficiency or energy savings. These technical developments include dimensionally stable anodes, polymer reinforced diaphragms, activated cathodes, and decreased anode/cathode gaps. The improved electrodes have lower overvoltages, while the polymer reinforced asbestos diaphragm has reduced swelling which enables the anode/cathode gap to be significantly decreased.

Present technology for preparing reinforced asbestos diaphragms requires the use of various polymeric reinforcing agents which are added to a slurry of asbestos fibers prior to deposition onto a cathode. The polymers used in this application must be resistant to attack and degradation by the electrolytic solution and cell products. Typical polymers include the fluoropolymers such as polytetrafluoroethylene and polychlorotrifluoroethylene.

After being deposite onto the cathode, the diaphragm/cathode structure is heated to the fusion point of the polymer and subsequently cooled to room temperature. The deposition of the slurry is effected by means of a vacuum. Polymer-reinforced diaphragms of this type are disclosed in U.S. Pat. No. 4,410,411, issued Oct. 18, 1983 to Fenn et al., U.S. Pat. No. 4,142,951, issued Mar. 6, 1979 to Beaver et al., and Canadian Patent No. 1,027,898 to Rucker. U.S. Pat. No. 4,142,951 also discloses that various surfactants, wetting agents, dispersing agents, modifiers or other processing aids can be added to the asbestos slurry in order to improve the dispersion of the asbestos fibers and fluorocarbon polymer and to impart increased porosity to the diaphragm. Titanium dioxide is listed in this patent as such a processing aid.

Although the polymer-reinforced diaphragms of the prior art do possess improved mechanical stability as compared to unmodified asbestos diaphragms, there are still opportunities for further technical improvements. For example, polymer-reinforced diaphragms prepared from polymers which are less resistant to the cell environment swell after a few days exposure to the cell environment, and the polymer itself tends to be degraded over a period of time, losing its capacity to effectively bond the fibers. Alternatively, when using more environmentally resistant polymers, the diaphragm-deposited cathode must be heated to the fusion temperature of the polymer which is typically in the range of about 350° C. In addition to requiring more expensive heating furnaces, the use of such high temperature conditions can accelerate the mechanical degradation of the cathode and diaphragm.

An attempt to overcome the shortcomings of polymer-modified asbestos diaphragms is disclosed in U.S. Pat. No. 4,180,449, issued Dec. 25, 1979, to Heikel. This patent utilizes an organic titanate, such as tetraisopropyl titanate, which is dissolved in a solvent capable of wetting the asbestos fibers, such as anhydrous isopropanol. The titanate solution is used to impregnate a diaphragm which has been previously deposited onto a cathode member by vacuum deposition. The diaphragm is dried prior to treatment with the titanate solution to prevent hydrolysis of the titanate compound. The titanate contained in the diaphragm must then be hydrolyzed prior to pyrolysis. Hydrolysis is carried out in the presence of a hydrolyzing agent, such as water vapor, while pyrolysis occurs at temperatures of about 400° C. The diaphragm produced according to this process is stated to be more durable and stable than unmodified diaphragms. However, this multistep process is both cumbersome and expensive to run commercially.

Patent application Ser. No. 941,459, filed Dec. 15, 1986, discloses and claims an asbestos diaphragm having the asbestos fibers bonded together with an oxide of titanium, zirconium, hafnium, niobium, tantalum or tungsten.

It is therefore a principle objective of the present invention to provide an improved process for preparing an electrolytic chlor-alkali cell diaphragm which has superior physical and electrical properties in comparison to diaphragms disclosed in the prior art and those currently in commercial use.

SUMMARY OF THE INVENTION

In accordance with the present invention, a process for preparing an improved electrolytic cell diaphragm comprises the steps of (A) forming an aqueous dispersion of at least one valve metal oxide selected from the group consisting of the oxides of titanium, zirconium, hafnium, niobium, tantalum, tungsten, and mixtures thereof, and at least one water-soluble solvent which is capable of wetting the valve metal oxide and the asbestos fibers, (B) mixing the dispersion with an additive and asbestos fibers to form a slurry, (C) immersing a cathode in the slurry and depositing a uniform mixture of slurry solids onto the cathode, (D) heating the diaphragm-deposited cathode at a temperature of at least about 100° C. to cure the diaphragm, and (E) allowing the diaphragm to cool.

Preferably, the cell is a chlor-alkali cell, the valve metal oxide of choice is titanium dioxide, the solvent of choice is isopropanol, and the additive of choice is poly(ethylene chlorotrifluoroethylene). A wetting agent can be incorporated in the slurry for improved wetting of the asbestos fibers and dispersion of the solids prior to deposition onto the cathode.

DETAILED DESCRIPTION OF THE INVENTION

The diaphragm of the present invention is formed by depositing treated asbestos fibers onto a suitable cathode member. The cathode member, which generally traverses the width of the cell and is adapted to be interposed between adjacent anode members, is a foraminous structure, such as a perforated sheet or expanded or woven metal screen. The cathode is generally fabricated from steel and may also have an activated coating on its surface.

Procedures for depositing the fibers onto the cathode are well known in the art and involve either one- or two-stage variations. In the one-stage process, a slurry containing a mixture of asbestos fiber and a fluoropolymer is deposited onto a cathode member, while in the two-stage process, asbestos fibers are first deposited and subsequently impregnated with a thermoplastic fluoropolymer. These techniques are disclosed in U.S. Pat. No. 4,410,411 and Canadian Patent No. 1,027,898, respectively, the disclosures of which are incorporated herein by reference.

Irrespective of the particular deposition process employed, the first step is the preparation of a slurry of asbestos fibers. Suitable asbestos fibers are also well known in the art and include the crocidolite and chrysotile varieties. Particularly suitable are mixtures of the Hooker 1 and Hooker 2 fibers, and preferably equal weight mixtures of these fibers.

The asbestos fiber slurry is modified by the addition thereto of a valve metal oxide, an additive and a water soluble solvent. The valve metal oxide and solvent are first combined as a dispersion and subsequently added to the asbestos slurry. which also contains the additive. This insures complete dispersion of the components in the slurry.

The valve metal oxide is in particulate or finely divided form, and is preferably a pigment grade material. For purposes of this invention, the term "valve metal" includes titanium, zirconium, hafnium, niobium, tantalum and tungsten, or mixtures of any of these materials. These metal oxides are electrical insulators and will not interfere with electrical processes occurring within the cell. The preferred valve metal oxide is titanium dioxide.

Any alkanol such as methanol, ethanol and propanol, including both branch and straight chain varieties, both substituted and unsubstituted, can be used as the solvent in the practice in this invention, the only provision being that the alkanol must be soluble in water and should be capable of thoroughly wetting the valve metal oxide and the asbestos fibers.

A particularly preferred alkanol is isopropanol. Isopropanol is capable of readily dispersing titanium dioxide and is also effective in thoroughly wetting the asbestos fibers to form a complete and uniform dispersion of the titanium dioxide within the fiber matrix. It has been found that the use of such a solvent is essential to the practice of this invention since its omission results in a lack of bonding of the titanium dioxide to the asbestos fibers as illustrated in Example 4 below. In the absence of such a solvent, the titanium dioxide is exceedingly difficult to disperse, and upon depositing the diaphragm onto the cathode, does not adhere to the asbestos.

The additive, preferably present in powder or fibrous form, includes a variety of polymeric and inorganic materials such as silicon dioxide, polyvinyl chloride, polyethylene, polypropylene, polytetrafluoroethylene, poly(ethylene chlorotrifluoroethylene), chlorinated polyvinyl chloride, chlorinated propylene, calcium carbonate and sodium chloride. Polytetrafluoroethylene and poly(ethylene chlorotrifluoroethylene) are sold under the trademarks "Teflon" and "Halar", respectively. The additive, when used in powdered form, typically has an average particle size of 0.2 to 5.0 microns.

A wetting agent can be suitably added to the dispersion for improved wetting of the asbestos fibers. Typical wetting agents include the Triton products, which are manufactured and sold by the Rohm & Haas Corp. A particularly suitable wetting agent is Triton X-100, which is a non-ionic octyl phenoxy polyethoxy ethanol compound. Although such wetting agents are generally effective for wetting the asbestos fibers, they are not effective in wetting the valve metal oxide particles, and therefore, must be employed in combination with a solvent such as isopropanol which possesses this capability.

The amounts of the individual components required to achieve the beneficial results of this invention are not critical, and can vary within wide limits. Preferably, the amount of valve metal oxide employed is in the range of from about 0.5% to about 3%, based on the weight of asbestos. The amount of additive employed is in the range of from about 2% to about 5%, also based on the weight of asbestos.

After the slurry has been prepared and thoroughly mixed, a cathode can be immersed threin and a vacuum applied through the cathode chamber to draw the fibers onto the cathode surface. The diaphragm-deposited cathode can then be removed from the slurry, dried and heated at a temperature of at least about 100° C., and preferably in the range of from about 100° C. to about 400° C., for a sufficient time to cure the diaphragm. Curing occurs when the asbestos fibers are firmly bound together to form an adherent and dimensionally stable structure, and is a function of the duration of the heat treatment and temperature employed.

A particular advantage of this invention is that a lower baking temperature can be employed then has been generally found necessary in the prior art. This assists in preventing damaging warpage of the cathode. In this manner, a diaphragm typically having a thickness of from about 30–125 mils can be obtained.

While the process of the present invention is primarily useful for preparing diaphragms for electrolytic cells, and particularly chlor-alkali cells, a variety of other useful articles can also be prepared following the procedure described herein, as will be readily understood by those skilled in the relevant art. These other articles include filters, mats and cords, as well as other porous structures formed from asbestos fibers by heating fibers which have been at least partially coated with a dispersion of a valve metal oxide in at least one solvent capable of wetting the valve metal oxide and asbestos fibers. The process of this invention is particularly useful for preparing such articles which are subject to high temperature conditions of use, since the inorganic binder does not decompose or degrade under such conditions.

The following examples are intended to further illustrate various embodiments of the present invention without limiting it thereby.

EXAMPLE 1

An asbestos slurry was prepared by mixing equal parts of Hooker #1 asbestos fiber and Hooker #2 asbestos fiber in a mixing tank containing cell liquor (average concentration about 150 gpl NaOH). Halar powder was added to the slurry and adjusted to a concentration in the range of from about 3.75% to about 4.20% by weight of asbestos. Approximately 10%, by weight of asbestos, of a 0.5% by weight solution of Triton X-100 wetting agent (trademark of Rohm & Haas Corp. for a non-ionic octyl phenoxy polyethoxy ethanol surfactant) was added to the slurry.

This slurry was thoroughly mixed, deposited onto a series of cathodes under vacuum and dried for about 2 hours under vacuum. The cathodes were then placed in an oven and heated to 100° C.–120° C. for 2 hours. The oven temperature was then raised to 240° C. and held for one hour at this temperature to cure the cathodes. The oven was then allowed to cool to ambient temperature.

The cathodes were then installed in a series of electrolytic chlor-alkali H-4/75 diaphragm cells, each cell containing 75 pairs of anodes and cathodes. After 50 days of operation at an average current of 150 KA and 160 gpl caustic, an average cell voltage of 3.90 volts and a caustic current efficiency of 95.5% were recorded. After 187 days of operation under these conditions, a caustic current efficiency of 88.4% was recorded.

EXAMPLE 2

An asbestos slurry was prepared following the procedure of Example 1. To this slurry was added a dispersion of approximately equal parts by weight of titanium dioxide powder and isopropyl alcohol at a concentration level for each component of from about 0.5% to about 1.5% by weight of asbestos. Approximately 10%, by weight of asbestos, of a 0.5% by weight solution of Triton X-100 was added to the slurry.

This slurry was thoroughly mixed, deposited onto a series of cathodes under vacuum and dried for about 2 hours under vacuum. The cathodes were then placed in an oven and heated to 100° C.–120° C. for 2 hours. The oven temperature was then raised to 240° C. and held for one hour at this temperature to cure the cathode. The oven was then allowed to cool to ambient temperature.

The cathodes were then installed in a series of electrolytic chlor-alkali H-4/75 diaphragm ells, each cell containing 75 pairs of anodes and cathodes. After 50 days of operation at an average current of 150 KA and 160 gpl caustic, an average cell voltage of 3.57 volts and a caustic current efficiency of 96% were recorded. After 187 days of operation under these conditions, a caustic current efficiency of 91.4% was recorded.

EXAMPLE 3

A series of electrolytic chlor-alkali H-4/75 diaphragm cells were operated as described in Examples 1 and 2, with one series of cells containing cathodes prepared as in Example 1 (without $TiO_2$) and the other series containing cathodes prepared as in Example 2 (with $TiO_2$). After 200 days of operation at an average current of 165 KA and 160 gpl caustic, the cathodes were removed from the cells and visually examined. The cathodes prepared according to Example 1 were swollen, while the cathodes prepared according to Example 2 did not swell.

Although various embodiments of this invention have been shown and described in the specification, this invention is intended to be construed liberally and not limited by any specific embodiments as will be readily appreciated by those skilled in the art. It is to be understood, therefore, that the appended claims are intended to cover all modifications and variations which are within the spirit and scope of the present invention.

What is claimed is:

1. A process for preparing a diaphragm for use in an electrolytic cell comprising the steps of:

(a) forming an aqueous dispersion of at least one valve metal oxide selected from the group consisting of the oxides of titanium, zirconium, hafnium, niobium, tantalum, tungsten, and mixtures thereof, and at least one water-soluble solvent which is capable of wetting the valve metal oxide and the asbestos fibers, (b) mixing the dispersion with an additive and asbestos fibers to form a slurry, (c) immersing a cathode in the slurry and depositing a uniform mixture of slurry solids onto the cathode, (d) heating the diaphragm-deposited cathode at a temperature of at least about 100° C. to cure the diaphragm, and (e) allowing the diaphragm to cool.

2. The process of claim 1 wherein the additive is selected from the group consisting of silicon dioxide, polyvinyl chloride, polyethylene, polypropylene, chlorinated polyvinyl chloride, chlorinated propylene, calcium carbonate and sodium chloride, polytetrafluoroethylene and poly(ethylene chlorotrifluoroethylene).

3. The process of claim 2 wherein the additive is poly(ethylene chlorotrifluoroethylene).

4. The process of claim 1 wherein the diaphragm is heated at a temperature of from about 100° C. to about 400° C.

5. The process of claim 1 wherein the amount of valve metal oxide is in the range of from about 0.5% to about 3% by weight of asbestos.

6. The process of claim 1 wherein the amount of additive is in the range of from about 2% to about 5% by weight of asbestos.

7. The process of claim 1 wherein at least one solvent is an alkanol.

8. The process of claim 7 wherein the alkanol is isopropanol.

9. The process of claim 8 wherein the valve metal oxide is titanium dioxide.

10. The process of claim 9 wherein the dispersion includes a wetting agent.

11. The process of claim 10 wherein the wetting agent is a non-ionic octyl phenoxy polyethoxy ethanol compound.

12. A chlor-alkali cell diaphragm prepared by the process of claim 1.

* * * * *